US005223848A

United States Patent [19]

Rammos et al.

[11] Patent Number: 5,223,848

[45] Date of Patent: Jun. 29, 1993

[54] DUPLEXING CIRCULARLY POLARIZED COMPOSITE

[75] Inventors: Emmanuel Rammos, Oegstgeest; Antoine G. Roederer, Noordwijk, both of Netherlands

[73] Assignee: Agence Spatiale Europeenne, France

[21] Appl. No.: 759,725

[22] Filed: Sep. 11, 1991

Related U.S. Application Data

[63] Continuation of Ser. No. 409,077, Sep. 19, 1989, abandoned.

[30] Foreign Application Priority Data

Sep. 21, 1988 [FR] France ..... 88 12332

[51] Int. Cl.[5] ..... H01Q 1/38; H01Q 5/00; H01Q 21/24

[52] U.S. Cl. ..... 343/700 MS; 343/853

[58] Field of Search ..... 343/700 MS, 778, 853, 343/756

[56] References Cited

U.S. PATENT DOCUMENTS

| | | | |
|---|---|---|---|
| 3,921,177 | 4/1973 | Munson | 343/700 MS |
| 3,971,032 | 8/1975 | Munson et al. | 343/700 MS |
| 4,356,492 | 10/1982 | Kaloi | 343/700 MS |
| 4,464,663 | 8/1984 | Lalezari et al. | 343/700 MS |
| 4,737,793 | 4/1988 | Munson et al. | 343/700 MS |
| 4,857,938 | 8/1989 | Tsukamoto et al. | 343/700 MS |

FOREIGN PATENT DOCUMENTS

| | | | |
|---|---|---|---|
| 1883 | 5/1979 | European Pat. Off. | 343/700 MS |
| 0270209 | 9/1987 | European Pat. Off. . | |
| 7706 | 1/1986 | Japan | 343/700 MS |
| 7707 | 1/1986 | Japan | 343/700 MS |
| 2189080 | 4/1986 | United Kingdom . | |

OTHER PUBLICATIONS

Microwave Journal, vol. 30, n° 4, Apr. 1987, pp. 87-96, Norwood, Mass., US; F. Lalezari et al.: "mm-Wave Microstrip Antennas".

*Primary Examiner*—Michael C. Wimer

*Attorney, Agent, or Firm*—Andrus, Sceales, Starke & Sawall

[57] ABSTRACT

A duplexing circularly polarized composite antenna comprises at least one pair of radiator elements supportings orthogonal (vertical and horizontal) linear polarization. One radiator element is fed with a signal with a phase difference of 90° relative to the signal fed to the other radiator element. Each radiator element transmits and/or receives signals at two different frequencies having orthogonal polarization. One radiator element operates at a first frequency with vertical polarization and a second frequency with horizontal polarization. The other radiator element operates at the first frequency with horizontal polarization and at the second frequency with vertical polarization.

10 Claims, 2 Drawing Sheets

DUPLEXING CIRCULARLY POLARIZED COMPOSITE

The present application is a continuation of U.S. patent application Ser. No. 07/409,077, filed Sep. 19, 1989, and now abandoned.

BACKGROUND OF THE INVENTION

1. Field of the Invention

The present invention concerns composite antennas transmitting and receiving simultaneously on two frequencies. A duplexer is generally used to separate the receive channel from the transmit channel, the power in which is much higher. It is necessary to provide a duplexer for each active element of the antenna with the result that the number of duplexers is equal to the number of active elements.

2. Description of the Prior Art

The duplexers are generally larger and heavier than the radiator elements; because of this the use of duplexers leads to a considerable increase in weight and overall dimensions, which is particularly troublesome in space applications. For this reason it is desirable to reduce the weight and the overall dimensions of the duplexer or even to eliminate it altogether.

One solution is to use opposite polarization for transmission and reception, the polarizer carrying out the necessary separation; however, this solution is generally not acceptable in complex systems.

Another solution described in the article by T SHIOKAWA et al in the journal IECE of Japan, technical report, AP 86-60, proposes the use of duplexing radiator elements to achieve operation with circular polarization. The radiator elements proposed in this document provide between 20 and 30 dB of isolation between transmission and reception and it is currently necessary to provide bandpass filters to achieve the necessary separation.

In both cases described the radiator elements are made up of two elementary radiator elements, one operating in transmission and the other in reception. These are ingeniously mounted to occupy the same area. In an implementation the first radiator element is a duplexing dual patch in the form of two plates of dielectric material coated with metal. This solution uses frequency selectivity between the top and bottom patches; it is of interest but it complicates the structure of the radiator element and consequently increases the weight and overall dimensions.

The impedance, the cross polarization performance and the configuration are affected by the disymmetry of the feed system. Also, major redesign is necessary to make the single patch dual and duplexing.

Another solution is described in French patent No. 2 570 546; this is a multifilar helix antenna comprising distinct helical radiators wound on a common core, offset in the angular direction and in a regular way relative to each other, at least two radiators of said antenna being connected continuously to a separate transmitter or receiver device.

This latter solution is not frequency selective and entails a loss of gain.

An object of the present invention is an antenna of the aforementioned type which makes it possible to avoid the problems that have just been described and to eliminate the duplexers. Also, the invention proposes to deal with the problem of passive intermodulation products, which can be a decisive factor in avoiding the use of two separate arrays for Tx-Rx operation (transmission and reception).

The invention has also the capability to cancel on-axis cross polarization and to yield symmetrical radiation patterns.

SUMMARY OF THE INVENTION

The present invention is directed to a duplexing circularly polarized composite antenna comprising at least one pair of radiator elements supporting orthogonal (vertical and horizontal) linear polarization in which one radiator element is adapted to be fed with a signal with a phase difference of 90° relative to the signal fed to the other radiator element and each radiator element transmits and/or receives signals at two different frequencies having orthogonal polarization, one radiator element operating at a first frequency with vertical polarization and a second frequency with horizontal polarization and the other radiator element operating at said first frequency with horizontal polarization and said second frequency with vertical polarization.

The use of circular polarization radiator elements enables simultaneous transmission and reception of two circularly polarized signals having identical polarization mode at different frequencies without mutual interference.

In one embodiment one frequency is used to transmit and the other frequency is used to receive.

In another embodiment of the invention the antenna is adapted to transmit at both frequencies or to receive at both frequencies.

In one embodiment of the invention the composite antenna comprises two pairs of radiator elements.

In accordance with another characteristic of the invention 3 dB hybrid couplers are used to split the feed to the antenna; this makes it possible to obtain two circular polarizations per frequency.

Uncompensated power divider means are advantageously provided in the edge region of the antenna.

In one practical embodiment of the invention the radiator elements are microstrip printed circuit patches and the feed lines are coplanar with the radiator elements; the feed lines are advantageously printed on the same substrate as the patches.

Finally, the feed lines for each frequency may be at different levels which limits the possibility of intermodulation coupling between bands.

Other characteristics and advantages of the invention will emerge from the following description given by way of non-limiting example only and with reference to the appended diagrammatic drawings.

DESCRIPTION OF THE PREFERRED EMBODIMENTS

The present invention is based on the use of composite or array antennas which comprise at least one pair of orthogonal linear polarization radiator elements, these two radiator elements being disposed relative to each other and fed in such a way as to provide circular polarization; the feed to the two radiator elements in each pair introduces a phase difference of 90° and it is therefore possible to transmit and receive simultaneously without using duplexers.

The possibility of achieving circular polarization using linear polarization radiator elements is described in the article by JOHN HUANG "A technique for an array to generate circular polarization with linearly polarized elements" published in the review "IEEE transactions on antennas and propagation", volume AP-34, No 9 of September 1986. FIGS. 1 through 4 show circularly polarized antennas of this kind.

Figure 1:
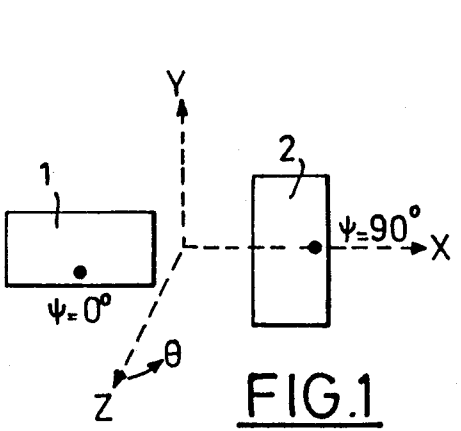
FIG. 1 shows a pair of radiator elements adapted to provide circular polarization.

FIG. 1 shows a first array antenna comprising a single pair of radiating elements the polarization modes of which are coplanar and orthogonal. These two elements, which may be in the form of rectangular printed circuit patches 1 and 2, are disposed perpendicularly to each other and fed with a phase difference of 90°, a first element 1 being fed with no phase-shift and a second element 2 being with a phase shift of 90°.

Figure 2:
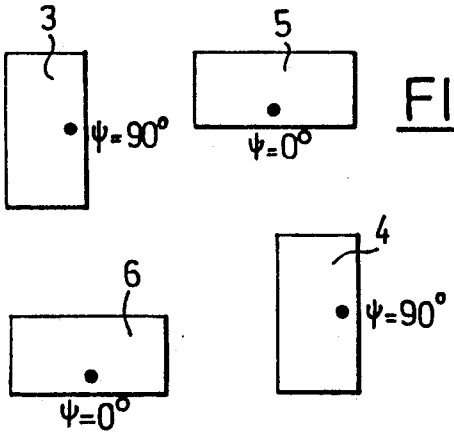
FIG. 2 shows two pairs of radiator elements disposed and fed in such a way as to provide circular polarization.

FIG. 2 shows a set of two pairs of orthogonal polarization radiator elements; the vertical polarization elements or patches 5 and 6 are combined with horizontal polarization patches 3 and 4. The horizontal polarization elements 3 and 4 are excited with a phase difference of 90° relative to the excitation of the vertical polarization elements 5 and 6. Righthand or lefthand circular polarization may be achieved according to the orientation and the phase of the excitation.

Figure 3:
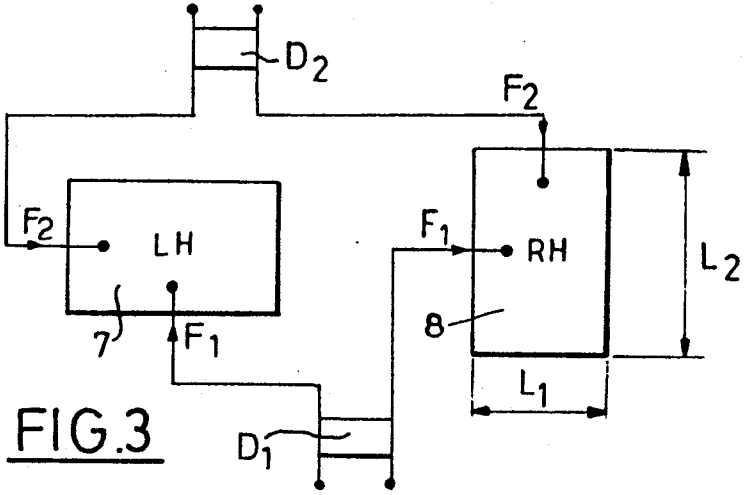
FIG. 3 shows a first embodiment of the invention.

The invention uses this type of feed producing circular polarization with frequency selectivity of the two radiating elements of the same pair. FIG. 3 is a schematic showing the feed circuit of an antenna of this kind comprising a single pair of two orthogonal linear polarization elements, namely first radiating element 8 and second radiating element 7. Each of these radiating elements is connected to the feed circuit at two connection points. Each radiating element of the pair receives and/or transmits first and second frequencies $F_1$ and $F_2$ respectively in first and second orthogonal linear excitation or polarization modes. Thus, second radiating element 7 is fed with a first signal from a first terminal at a first frequency $F_1$, at which it radiates with a first vertical linear polarization mode. The second radiating element is also fed with a second signal from a second terminal at a second frequency $F_2$, at which it radiates with a second horizontal linear polarization mode. Radiating element 8 of the pair is fed in the converse way, that is, it receives or transmits the first frequency $F_1$ at which it radiates with a second, horizontal linear polarization mode. Radiating element 8 is also fed with a second frequency $F_2$, at which it radiates with a first vertical linear polarization. In other words, each radiating element supports two orthogonal linear polarization modes at two different frequencies.

The phase difference in the feed for each frequency is achieved by a first phase shift means $D_1$ and by a second phase shift means $D_2$. Phase shift means $D_1$ and $D_2$ may comprise dividers or splitters such as 3 dB hybrid power dividers; other power dividers or splitters may also be used, such as T-splitters with different feed line lengths to create the phase difference. Each phase shift means has two opposed signal points, with the phase shift occurring between the signal points.

The radiating elements 7 and 8 are fed at frequencies $F_1$ and $F_2$ in such a way that the set of the two radiating elements creates lefthand or righthand circular polarization according to the distribution of the frequencies to each radiating element.

The radiator elements of each pair must be impedance matched at the two frequencies in their orthogonal directions so as to avoid a reduction in gain. The resonant frequencies are determined by an appropriate choice of the dimensions L1 and L2 of the patch constituting the radiator element.

Any appropriate type of linear polarization radiator element may be used such as crossed printed dipoles, slots, horns, etc instead of the microstrip patches shown in the figures.

In the case of patches, two-layer printed patches may be used. In this case the gap between the elements is smaller than with circular polarization double excitation patches, where more mutual coupling is present.

Figure 5:
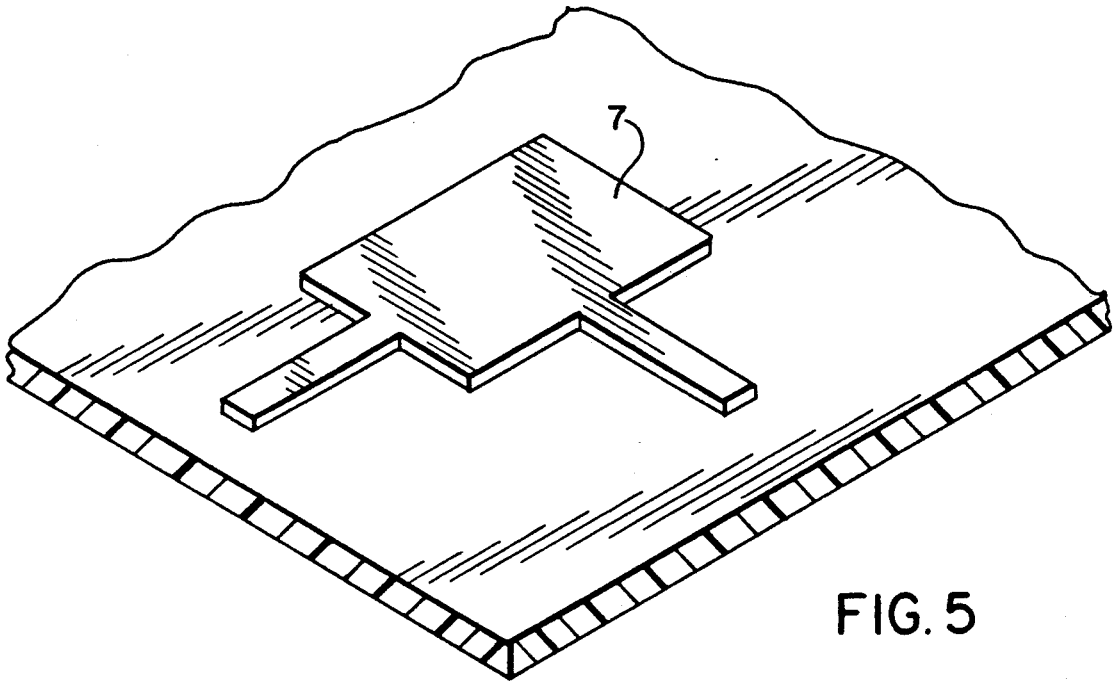
FIG. 5 shows one configuration for forming the antenna of the present invention.
Figure 6:
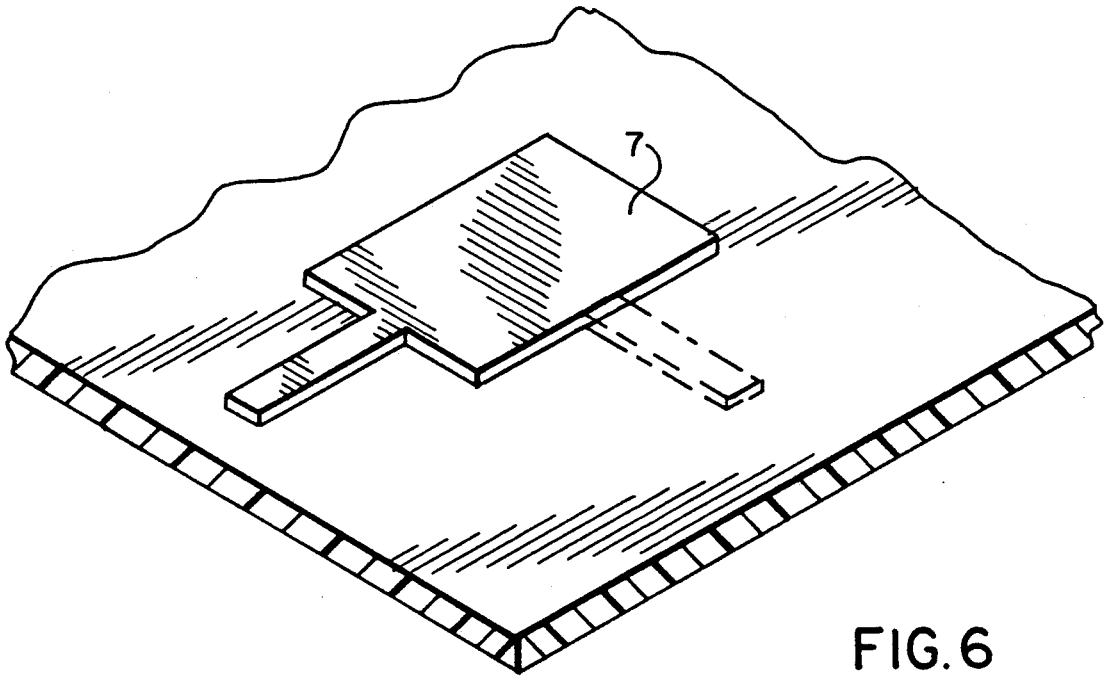
FIG. 6 shows another configuration for forming the present invention.

The feed arrays may be in the same plane as the elements; they are printed on the same substrate in the case of elements implemented in printed circuit form. See FIG. 5. In the case of flat elements, the various feed lines may be at different levels. See FIG. 6. In particular, the feed arrays corresponding to the two frequencies may be placed on separate levels which limits the possibility of any intermodulation or erratic signals being coupled from one band into the other.

The antenna shown in FIG. 3 comprises a single pair of elements and may be used for simultaneous transmission-reception, one frequency being used for transmission and another frequency for reception, or for transmission or reception on both frequencies.

In the case of a composite antenna comprising a single pair of radiator elements, that is to say in the case of FIG. 3, the boresight radiation can be perfectly circularly polarized but the radiation patterns will not be symmetrical.

Figure 4:
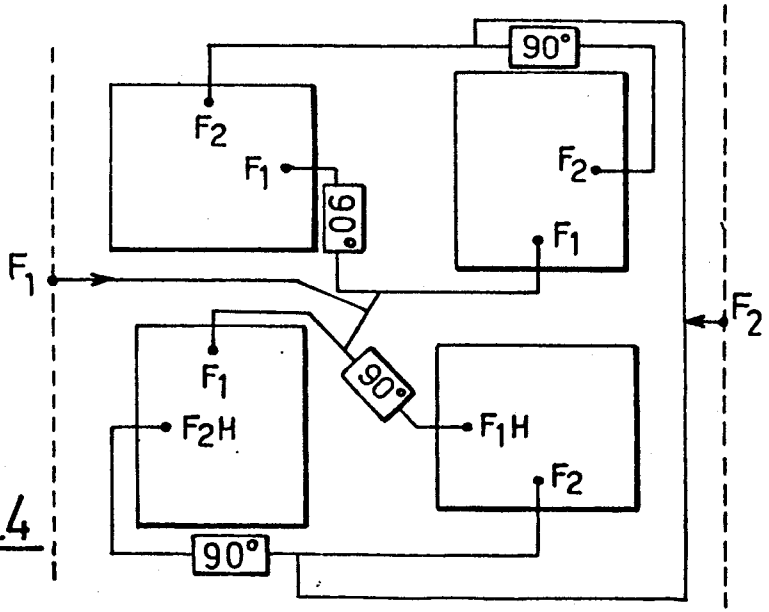
FIG. 4 shows a second embodiment of the invention.

It is also possible to use an array antenna comprising two pairs of radiator elements as shown in FIG. 4. In this case the radiation patterns will be symmetrical because of the symmetry of the configuration itself and an antenna of this kind with two pairs of elements is therefore preferable.

If the power division is achieved by means of T-splitters there can be only one circular polarization per frequency; on the other hand, if 3 dB hybrid couplers are used two circular polarizations can be obtained per frequency should this be necessary.

The embodiment shown in FIG. 4 makes it possible to have all the feed lines on the same level; they may be implemented in printed circuit form at the same time as the radiator elements; they may also be implemented in microstrip form, in stripline form or in squareaxe form fixed below the base plane.

The invention makes it possible to implement an antenna which is very simple as compared with the complex prior art duplexing antennas. Also, the feed method is compatible with any type of linearly polarized dual radiator.

One reason for the simplicity of the antenna in accordance with the invention is that there is no need to modify the design of the radiator element.

The optimized performance of the radiator, in particular with regard to cross polarization and reduced mutual coupling, also improves the symmetry of the radiation pattern.

Passive intermodulation products generated in the transmitter circuit are isolated from the receive channel, which is not the case in conventional array antennas in which the transmit and receive channels use the same feed array upstream of the duplexer. This must be a decisive factor in avoiding the need to use two separate arrays for transmitter-receiver (Tx-Rx) operation.

The method of feeding a duplexing array in accordance with the invention covers L band arrays and makes possible application to arrays and feeds of the European Data Relay Sattelite, the ARAMIS active array, the LOCSTAR radiators, etc.

The above description is given by way of non-limiting example only and it is obvious that modifications may be made thereto or variants thereof proposed without departing from the scope of the present invention.

In particular, the invention applies to array antennas comprising any number of pairs of linearly polarized radiator elements provided that they are appropriately oriented and phased. Also, as indicated above, the invention applies to any type of linearly or even elliptically polarized radiators.

It may be necessary to use uncompensated division by means of a T-splitter or hybrid power dividers, in particular in the edge region of an array in which the mutual coupling conditions would not be symmetrical and might induce cross polarization with a balanced system.

There is claimed:

1. A composite antenna that provides isolation between a first signal applied to a first terminal and a second signal applied to a second terminal, said first and second signals being either simultaneously transmitted or simultaneously received, or one of said signals being transmitted while the other signal is being received, said first signal having a first frequency and said second signal having a second frequency, said antenna comprising:

a first radiating element, including
- a first main axis;
- a first connection point adapted to transmit and/or receive said second signal according to a first polarization mode;
- a second connection point adapted to transmit and/or receive said first signal according to a second polarization mode, said second polarization mode being orthogonal to said first polarization mode;

a second radiating element, including
- a second main axis that is substantially at a right angle to said first main axis;
- a third connection point adapted to transmit and/or receive said second signal according to said second polarization mode;
- a fourth connection point adapted to transmit and/or receive said first signal according to said first polarization mode;

a first means for applying a first phase shift of substantially 90°, including
- a first signal point connected to said first terminal and to said second connection point;
- a second signal point connected to said fourth connection point, said first phase shift being applied between said first signal point and said second signal point;

a second means for applying a second phase shift of 90°, including
- a third signal point connected to said second terminal and to said third connection point;
- a fourth signal point connected to said first connection point, said second phase shift being applied between said third signal point and said fourth signal point;

whereby said first radiating element receives and/or transmits said second signal without phase shift according to said first polarization mode;

whereby said first radiating element receives and/or transmits said first signal with phase shift of substantially 90° according to said second polarization mode;

whereby said second radiating element receives and/or transmits said first signal without phase shift according to said first polarization mode; and whereby said second radiating element receives and/or transmits said second signal with phase shift of substantially 90° according to said second polarization mode.

2. A composite antenna according to claim 1, wherein at least one of said first and second means for applying a phase shift comprises a 3 dB hybrid divider means for splitting the first or second signal to the respective radiating element of the antenna.

3. A composite antenna according to claim 1, further comprising:

feed lines connected to said connection points, said feed lines and said radiating elements being coplanar and printed on a common substrate.

4. A composite antenna according to claim 1, wherein said first and second radiating elements are substantially rectangular, so that each has a length according to its respective main axis adapted for said first frequency and a width perpendicular to its respective main axis adapted for said second frequency.

5. A composite antenna according to claim 1, further comprising:

a first feed array for said first signal; and a second feed array for said second signal, said second feed array being disposed on a different level from said first feed array.

6. A composite antenna that provides isolation between a first signal applied to a first terminal and a second signal applied to a second terminal, said first and second signals being either simultaneously transmitted or simultaneously received, or one of said signals being transmitted while the other signal is being received, said first signal having a first frequency and said second signal having a second frequency, said antenna comprising:

a first radiating element, including:
- a first main axis;
- a first connection point adapted to transmit and/or receive said first signal according to a first polarization mode;
- a second connection point adapted to transmit and/or receive said second signal according to a second polarization mode, said second polarization mode being orthogonal to said first polarization mode;

a second radiating element, including:
- a second main axis that is substantially at a right angle to said first main axis;

a third connection point adapted to transmit and/or receive said first signal according to said second polarization mode;

a fourth connection point adapted to transmit and/or receive said second signal according to said first polarization mode;

a first means for applying a first phase shift of substantially 90°, including a first signal point connected to said second terminal;

a second signal point connected to said second connection point, said first phase shift being applied between said first signal point and said second signal point;

a second means for applying a second phase shift of substantially 90°, including a third signal point connected to said first terminal;

a fourth signal point connected to said third connection point, said second phase shift being applied between said third signal point and said fourth signal point;

a third radiating element, including a third main axis that is substantially parallel to said first main axis;

a fifth connection point adapted to transmit and/or receive said first signal according to said first polarization mode;

a sixth connection point adapted to transmit and/or receive said second signal according to said second polarization mode;

a fourth radiating element, including a fourth main axis that is substantially parallel to said second main axis;

a seventh connection point adapted to transmit and/or receive said first signal according to said second polarization mode;

an eighth connection point adapted to transmit and/or receive said second signal according to said first polarization mode;

a third means for applying a third phase shift of substantially 90°, including a fifth signal point connected to said second terminal;

a sixth signal point connected to said sixth connection point, said third phase shift being applied between said fifth signal point and said sixth signal point;

a fourth means for applying a fourth phase shift of substantially 90°, including a seventh signal point connected to said first terminal;

an eighth signal point connected to said seventh connection point, said fourth phase shift being applied between said seventh signal point and said eighth signal point;

whereby said first and third radiating elements receive and/or transmit said first signal without phase shift according to said first polarization mode;

whereby said first and third radiating elements receive and/or transmit said second signal with phase shift of substantially 90° according to said second polarization mode;

whereby said second and fourth radiating elements receive and/or transmit said first signal with phase shift of substantially 90° according to said second polarization mode; and whereby said second and fourth radiating elements receive and/or transmit said second signal without phase shift according to said first polarization mode.

7. A composite antenna according to claim 6, wherein at least one of said first, second, third and fourth means for applying a phase shift comprises a 3 dB hybrid divider means for splitting the first or second signal to the respective radiating element of the antenna.

8. A composite antenna according to claim 6, further comprising:

feed lines connected to said connection points, said feed lines and said radiating elements being coplanar and printed on a common substrate.

9. A composite antenna according to claim 6, further comprising a first feed array for said first signal; and a second feed array for said second signal, said second feed array being disposed on a different level from said first feed array.

10. A composite antenna according to claim 6, wherein said first, second, third and fourth radiating elements are substantially rectangular, so that each has a length according to its respective main axis adapted for said first frequency and a width perpendicular to its respective main axis adapted for said second frequency.

* * * * *

UNITED STATES PATENT AND TRADEMARK OFFICE

CERTIFICATE OF CORRECTION

PATENT NO. : 5,223,848

DATED : June 29, 1993

INVENTOR(S) : Rammos, et al

It is certified that error appears in the above-indentified patent and that said Letters Patent is hereby corrected as shown below:

On title page, item [54] and col. 1, line 2,

After the word "Composite" insert ---Antenna---

Signed and Sealed this

Twelfth Day of April, 1994

Bruce Lehman

*Attest:*

BRUCE LEHMAN

*Commissioner of Patents and Trademarks*

*Attesting Officer*